US010493319B2

(12) United States Patent
Velert

(10) Patent No.: US 10,493,319 B2
(45) Date of Patent: Dec. 3, 2019

(54) EXERCISE EQUIPMENT FOR LIMITED MOBILITY INDIVIDUALS

(71) Applicant: Miguel Velert, Florence, SC (US)

(72) Inventor: Miguel Velert, Florence, SC (US)

(73) Assignee: Maven Theraphy LLC, Florence, SC (US)

( * ) Notice: Subject to any disclaimer, the term of this patent is extended or adjusted under 35 U.S.C. 154(b) by 862 days.

(21) Appl. No.: 14/997,739

(22) Filed: Jan. 18, 2016

(65) Prior Publication Data

US 2016/0206915 A1 Jul. 21, 2016

Related U.S. Application Data

(60) Provisional application No. 62/104,266, filed on Jan. 16, 2015.

(51) Int. Cl.
*A61H 1/00* (2006.01)
*A63B 22/06* (2006.01)
(Continued)

(52) U.S. Cl.
CPC ..... *A63B 22/0605* (2013.01); *A63B 22/001* (2013.01); *A63B 22/0005* (2015.10);
(Continued)

(58) Field of Classification Search
CPC ..... A63B 22/0605; A63B 22/001; A63B 22/0005; A63B 21/1672; A63B 21/012; A63B 2225/09; A63B 2208/0228; A63B 2022/0652; A63B 21/00069; A63B 2225/093; A63B 2210/04; A63B 2208/0252; A63B 2071/0018; A63B 2069/0062; A63B 2022/0094; A63B 21/154; A63B 23/03516; A63B 23/03575;
(Continued)

(56) References Cited

U.S. PATENT DOCUMENTS 3,693,614 A 9/1972 Schon
4,222,376 A 9/1980 Praprotnik
(Continued)

*Primary Examiner* — Quang D Thanh
(74) *Attorney, Agent, or Firm* — Kim and Lahey Law Firm LLC; Douglas W. Kim

(57) ABSTRACT

This invention is directed to an exercising apparatus for individuals with spinal injuries including; a frame having a vertically adjustable vertical standard; a forked base having a space defined in the forked base for receiving a wheelchair; a resistance assembly pivotally attached to the vertical standard having a vertical position, and a horizontal position so that an individual can use the exercise apparatus while sitting in a wheelchair in the vertical position and while inclined on a horizontal surface in the horizontal position; and, a resistance member included in the resistance assembly to increase the amount of force needed to rotate the resistance assembly. The invention can include a first pedal assembly for being rotated by hand and a second pedal assembly linked to the first pedal assembly so that when the first pedal assembly is rotated, the second pedal assembly rotates. The forked base can be disposed under the horizontal surface in the horizontal position. The resistance assembly can include foot pedals having a strap for securing the individual feet to the pedals.

10 Claims, 12 Drawing Sheets

(51) Int. Cl.

| | |
|---|---|
| ***A63B 22/00*** | (2006.01) |
| *A63B 21/00* | (2006.01) |
| *A63B 69/00* | (2006.01) |
| *A63B 71/00* | (2006.01) |
| *A63B 21/012* | (2006.01) |
| *A63B 21/16* | (2006.01) |

(52) U.S. Cl.
CPC ..... *A63B 21/00069* (2013.01); *A63B 21/012* (2013.01); *A63B 21/154* (2013.01); *A63B 21/1672* (2015.10); *A63B 2022/0094* (2013.01); *A63B 2022/0652* (2013.01); *A63B 2069/0062* (2013.01); *A63B 2071/0018* (2013.01); *A63B 2208/0228* (2013.01); *A63B 2208/0252* (2013.01); *A63B 2210/04* (2013.01); *A63B 2225/09* (2013.01); *A63B 2225/093* (2013.01)

(58) Field of Classification Search
CPC ..... A63B 23/04; A63B 23/0476; A63B 23/12; A61H 1/02; A61H 1/0237; A61H 1/0255; A61H 1/0274; A61H 2201/1253; A61H 2201/1261; A61H 2201/1269; A61H 2201/1276; A61H 2201/1635; A61H 2201/1638; A61H 2201/164; A61H 2201/14642; A61H 2203/0425; A61H 2203/0431; A61H 2203/0456
See application file for complete search history.

(56) References Cited

U.S. PATENT DOCUMENTS

| | | | | |
|---|---|---|---|---|
| 4,402,502 | A * | 9/1983 | Peters | A61H 1/0214 482/139 |
| 4,765,614 | A | 8/1988 | Shute | |
| 4,846,156 | A | 7/1989 | Kopnicky | |
| 5,232,422 | A | 8/1993 | Bishop | |
| 5,277,685 | A | 1/1994 | Gonzales | |
| D365,860 | S | 1/1996 | Giger | |
| 5,536,228 | A | 7/1996 | Tanner, Jr. | |
| 6,036,623 | A | 3/2000 | Mitchell | |
| 6,446,877 | B1 | 9/2002 | Gaines et al. | |
| 6,592,502 | B1 * | 7/2003 | Phillips | A61H 1/0214 482/121 |
| D526,368 | S | 8/2006 | Giger | |
| D531,237 | S | 10/2006 | Giger | |
| 7,494,450 | B2 | 2/2009 | Solomon | |
| 7,530,932 | B2 | 5/2009 | Lofgren | |
| 7,722,509 | B2 | 5/2010 | Eder | |
| 7,909,742 | B2 | 3/2011 | Lines | |
| 8,888,664 | B1 * | 11/2014 | Butler | A63B 21/154 482/100 |
| 2011/0082014 | A1 * | 4/2011 | Leonhard | A63B 21/0052 482/57 |
| 2016/0258573 | A1 * | 9/2016 | Goldish | F16M 11/42 |

* cited by examiner

EXERCISE EQUIPMENT FOR LIMITED MOBILITY INDIVIDUALS

BACKGROUND OF THE INVENTION

Field of the Invention

This invention is directed to an exercise apparatus designed to assist individuals with limited mobility to exercise paralyzed limbs.

Description of Related Art

It has been reported that spinal cord injuries resulting in paralysis of some type affect more than 250,000 people in the United States. (See National Spinal Cord Injury Statistical Center). These individuals typically have a long term commitment to a wheelchair. Challenges are present for these individuals in order to maintain physical fitness levels. The sedentary lifestyle that accompanies spinal injury individuals can lead to secondary complications that include diabetes mellitus, hypertension, and atherogenic lipid profiles. Therefore, structured exercise activities should be included in the daily or weekly schedule to reduce the chance of these secondary complications.

Maintaining muscle tone or at least reducing muscle mass loss in the legs is a challenging problem for individuals with spinal cord injuries. Since the ability to move one's legs is limited or non-existent, having outside forces act on the legs to generate motion is very beneficial. Some attempts exist to have an arm and leg exerciser that uses the arm motion to rotate the hand cycle, that in turn drives the leg pedals causing the legs to move. One attempt is the Saratoga Spirit 690 Selectable Arm/Leg Exerciser. This attempt is limited to the individual being in the sitting position.

There have been several other attempts to address these exercise needs for those with spinal cord injuries, including U.S. Pat. No. 4,765,614. This patent discloses an exercise machine having a frame that extends outwardly beyond the backrest and a plurality of ramp members that are pivotally connected to the frame, so that the person confined to a wheelchair can back onto the ramp members and each will pivot toward the machine, thereby allowing the person confined to the wheelchair, to back up to the machine until their back is against the backrest of the exercise machine. However, this reference is limited in that its use is to an individual in a sitting position. Further, the footprint of this machine is great and it cannot be easily stored.

U.S. Pat. No. 5,277,685 is also a machine designed to be used while the individual is in the sitting position. Further, the construction of this apparatus includes weights that are carried by the frame making easy storage and transportation of this apparatus simply not practical. U.S. Pat. No. 5,536,228 also has a large footprint, is limited to the individual being in the sitting position, and does not allow for the exercise of the legs.

U.S. Pat. No. 7,530,932 is an upper body exerciser that includes a seat connected to a frame. A wheel is positioned in association with the frame, and pedals are configured to interact with a drive unit and the drive unit is operatively connected to a wheel. Hand pedals and crank arms are configured to rotate independently of each other, may be provided that enable further variation in muscle groups used and enhance the upper body exercise provided by the upper body spinning experience.

U.S. Pat. No. 7,494,450 is directed to an exercise device for use while performing a cardiovascular exercise such as walking or running on a treadmill, cycling on a stationary bicycle, or other cardiovascular exercise using a cardiovascular or other exercise device or machine, which provides the capability for unweighting or unloading in a variety of ways a desired portion of the person's weight supported on weight bearing elements of the cardiovascular exercise device or machine, and performing numerous resistance exercises and stretches. While offering overhead exercise options, it is not suited for an individual with a spinal cord injury.

There are several disadvantages with the prior art that include the inability for the individual to exercise while inclined on a table or other horizontal surface. Further, the prior art does not include an apparatus that can be easily removed from over a table, allowing the individual to easily mount the table, and be repositioned to allow the individual overhead exercise options. Further, the prior art does not include an apparatus to assist spinal cord injury individuals with exercise that can be converted from a sitting position to an overhead position. Further, the prior art does not include an apparatus to assist spinal cord injury individuals with exercise that can be easily stored and transported.

Therefore it is an object of the present invention to provide for an exercise unit that is easily transportable, storable, and can convert from sitting exercises to inclined exercises.

DESCRIPTION OF THE DRAWINGS

The invention shall be described in the following by means of an example and referring to the enclosed drawings, where.

BRIEF SUMMARY OF THE INVENTION

Figure 1:
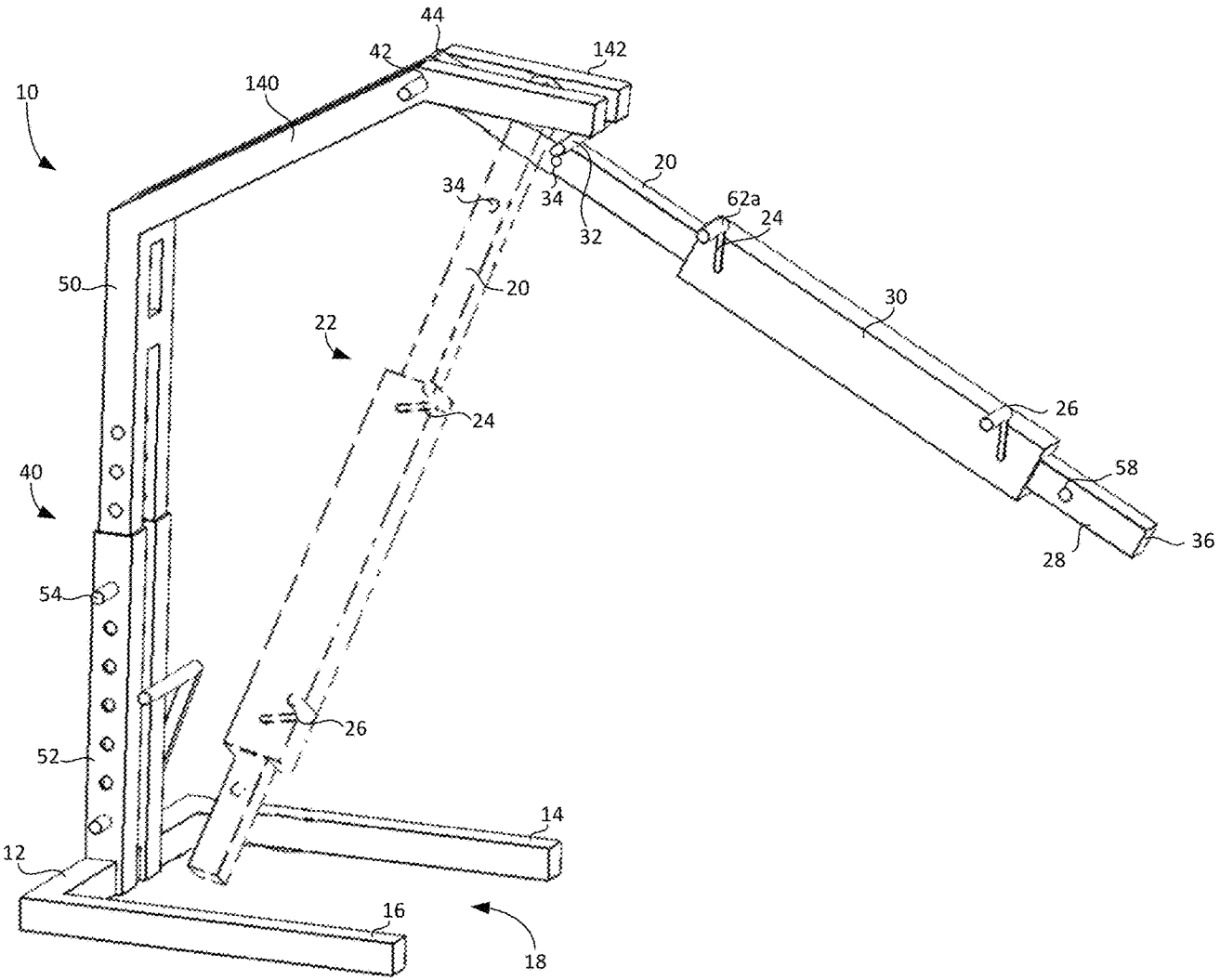
FIG. 1 is a perspective view of the present invention showing a horizontal and vertical configuration.

The above objections are accomplished by providing an exercising apparatus for individuals with spinal injuries comprising; a frame having a vertically adjustable vertical standard; a forked base having a space defined in the forked base for receiving a wheelchair; a resistance assembly pivotally attached to the vertical standard having a vertical position and a horizontal position so that an individual can use the exercise apparatus while sitting in a wheelchair in the vertical position and while inclined on a horizontal surface in the horizontal position; and, a resistance member included in the resistance assembly to increase the amount of force needed to rotate the resistance assembly.

The invention can also include: a frame attached to a support and having a vertical standard, an upper extension and an upper overhang; a resistance assembly rotateably attached to the upper overhang at a pivot and configured to rotate between a generally horizontal position configured to provide exercise assistance to the individual in a horizontal position and a generally vertical position configured to provide exercise assistance to the individual in a seated position; a pivot pin received into a beam included in the resistance assembly and the upper extension to secure the resistance assembly in the generally horizontal position; a stabilizing pin received into the vertical standard and a distal end of the resistance assembly when the resistance assembly is in a vertical position configured to secure the resistance assembly in a generally vertical position; a drive system slidably attached to the beam and including a master pedal assembly configured to be actuated by the hands and arms of the individual, the master pedal assembly including a master axle and a pair of offset master pedals attached to a master pulley; a slave pedal assembly included in the drive system configured to support the feet and legs of the individual, the slave pedal assembly including a slave axle and a pair of slave pedals attached to a slave pulley; a linkage connecting the master pedal assembly with the slave pedal assembly configured to actuate the slave pedal assemble when the master pedal assembly is actuated; the master pedal assembly, slave pedal assembly and linkage cooperatively slideable along the drive system to vary the distance between the master pedal assembly and the slave pedal assembly; an idler assembly included in the drive system having a forward idler and a rearward idler biased toward each other so that when the master pedal assembly is positioned closer to the slave pedal assembly within the drive system the idler assembly reduces the slack created in the linkage; and, a tension member in contact with the linkage configured to apply adjustable radial force to the linkage to vary the tension between the master pedal assembly and the slave pedal assembly.

The slave pedal assembly can be connected to the rearward idler so that when the slave pedal assembly is moved toward the master pedal assembly along the drive system, the slack in the linkage is taken up by the idler assembly; and, the master pedal assembly can be connected to the forward idler so that when the master slave pedal assembly is moved toward the slave pedal assembly along the drive system, the slack in the linkage is taken up by the idler assembly.

A pair of forks can be attached to the support projecting inward defining a space for receiving a chair so that when the resistance assembly is in the vertical positions, the individual can access the drive system while sitting. The pair of forks can be received under a horizontal surface to position the resistance assembly above the horizontal surface when the resistance assembly is in the generally horizontal position so that an individual supported by the horizontal surface can assess the drive system when supported by the horizontal surface. The support can include a horizontal surface and the vertical standard is pivotally attached to the horizontal surface positioning the resistance assembly above the horizontal surface so that the horizontal surface, vertical standard and resistance assembly are in generally a "Z" configuration. A mattress can be supported by the horizontal surface having a mattress slot defined in the mattress for receiving the vertical support so that the vertical support extends from the horizontal support upwards through the mattress. The horizontal surface is a bed support attached to a bed frame.

A distal angled end can be attached between the vertical standard and the horizontal support configured to position a support pivot defined between the horizontal support and the vertical standard generally under the individual supported by the horizontal support.

A frame attached to a support and having a vertical standard with a beam rotatably attached to the support at a pivot and configured to rotate between a generally horizontal position and a generally vertical position. The mattress supported by the horizontal surface can include a mattress slot defined in the mattress for receiving the vertical support so that the vertical support extends through the mattress. The horizontal surface can be a bed support attached to a bed frame.

The horizontal surface can be attached to the vertical standard wherein the vertical stand can pivot about a support pivot configured to be generally parallel with the horizontal surface thereby positioning the resistance assembly generally vertically in relation to the horizontal surface so that individual can use the resistance assembly in a seated position.

DETAILED DESCRIPTION OF THE INVENTION

It will be understood by those skilled in the art that one or more aspects of this invention can meet certain objectives, while one or more other aspects can meet certain other objectives. Each objective may not apply equally, in all its respects, to every aspect of this invention. As such, the preceding objects can be viewed in the alternative with respect to any one aspect of this invention. These and other objects and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. In particular, while the invention is described herein with reference to a number of specific embodiments, it will be appreciated that the description is illustrative of the invention and is not constructed as limiting of the invention. Various modifications and applications may occur to those who are skilled in the art, without departing from the spirit and the scope of the invention, as described by the appended claims. Likewise, other objects, features, benefits and advantages of the present invention will be apparent from this summary and certain embodiments described below, and will be readily apparent to those skilled in the art. Such objects, features, benefits, and advantages will be apparent from the above in conjunction with the accompanying examples, data, figures, and all reasonable inferences to be drawn therefrom, alone or with consideration of the references incorporated herein.

Reference will now be made in detail to the preferred embodiments of the present invention, examples of which are illustrated in the accompanying drawings. While the present invention will be described in conjunction with the preferred embodiments, it will be understood that they are not intended to limit the present invention to these embodiments. On the contrary, the present invention is intended to cover alternatives, modifications, and equivalents, which may be included within the spirit and scope of the present invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well-known methods, procedures, components, and circuits have not been described in detail so as not to unnecessarily obscure aspects of the present invention.

Referring to FIG. 1, the invention shown generally as 10 can include a forked base 12 that can include a right leg 14 and a left leg 16. The legs can be separated sufficiently to allow a wheel chair to be received in space 18 defined between the legs. When the individual enters the space, the resistant assembly 20 can be rotated into a first position shown generally as 22 to allow the resistant assembly to be position in front of the seated individual. The individual can then use the first pedal assembly 24 with their hands. The legs can be secured to a second pedal assembly 26 using foot straps to secure the feet to pedals included in the second pedal assembly. The foot straps allow the feet to be secured to the pedals when the pedals are rotated.

The resistance assembly can include a beam 28 and drive system 30 attached to the beam. The drive system can include the first and second pedal assemblies. The drive system can include a linkage between the first and second pedal assembly so that rotating the pedal of the first pedal assembly causes the pedals of the second pedal assembly to rotate. Therefore, when the individual's feet are secured to the second pedal assembly, the rotational force from the hands on the first pedal assembly causes the second pedal assembly to rotate resulting in exercise to the individual's legs. Additionally, the drive system can include a resistance member that places resistance, through friction, on the axle connection of the crank arms so that physical exertion required to turn the pedals can be varied.

The beam can be placed in a horizontal position and secured in place with pin 32 that can be received in opening 34 to secure the beam in the horizontal position. In this position, the beam's distal end 36 extends away from a vertical standard 40. The beam can pivot about pivot 42 to be raise into its vertical position. The pivot can be attached to the beam proximal end 44.

The vertical standard can include an upper portion 50 and a lower portion 52 that can receive the upper portion. Each portion can include a multiple of openings for receiving height adjustment pin 54 that can secure the vertical stand to a desired height. The upper and lower portions can include double tubes 50*a* and 50*b* and 52*a* and 52*b* respectively. The tubes can have a rounded or squared cross-section of a combination thereof. The upper portion 50 can carry a first lateral portion 140 and a second lateral portion 142.

The beam can be rotated into a vertical position shown by the dotted lines of FIG. 1. The distal end of the beam can be secured to the vertical standard for stability by stabilizing pin 56 that can be received on the opening of the vertical standard and received through distal opening 58 of the beam. When pin 32 is removed, the beam can swing downward. In one embodiment the pins 32 and 56 are "U" shaped pins.

Figure 2:
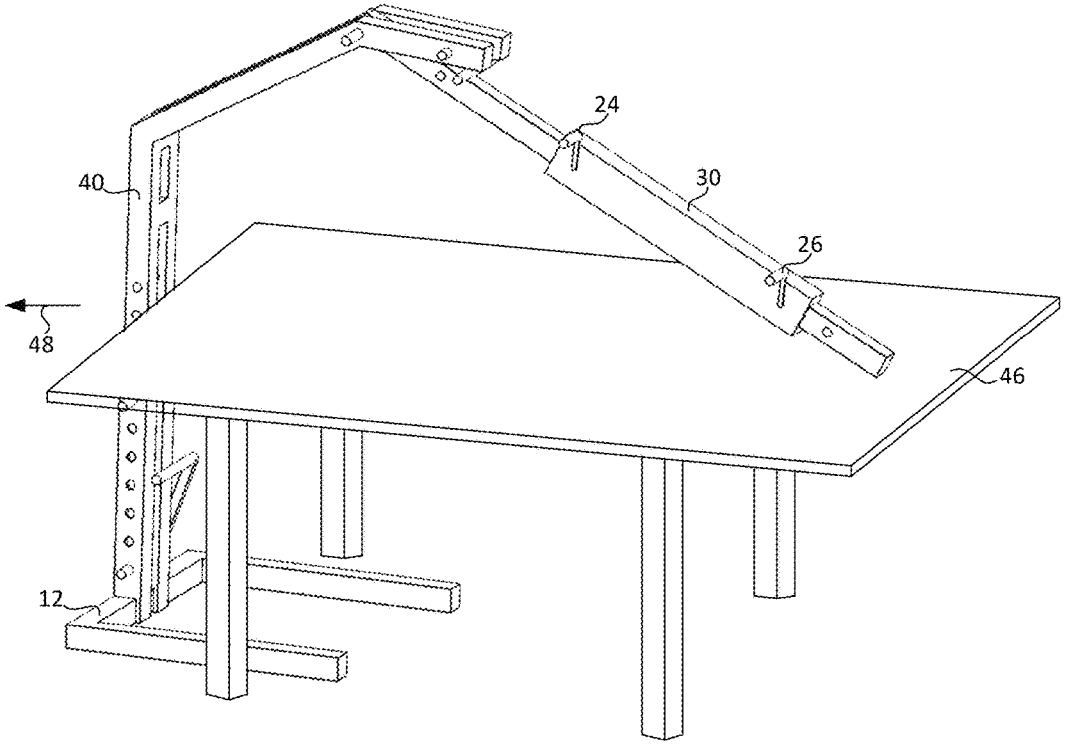
FIG. 2 is a perspective view showing the invention used with horizontal support surface.

Referring to FIG. 2, the invention is shown in its horizontal configuration. The table having a horizontal surface 46 can support the exercising individual. The individual can mount the table with the apparatus pulled away from the table in a direction shown as 48. When the individual is on the table, the apparatus can be pushed under the table so that the forked base is disposed under the table and the resistance assembly is above the table. The individual can secure the feet to the second pedal assembly and use the first pedal assembly to exercise. When completed, the apparatus can be moved away from the table and the individual can easily dismount the table.

Figure 3:
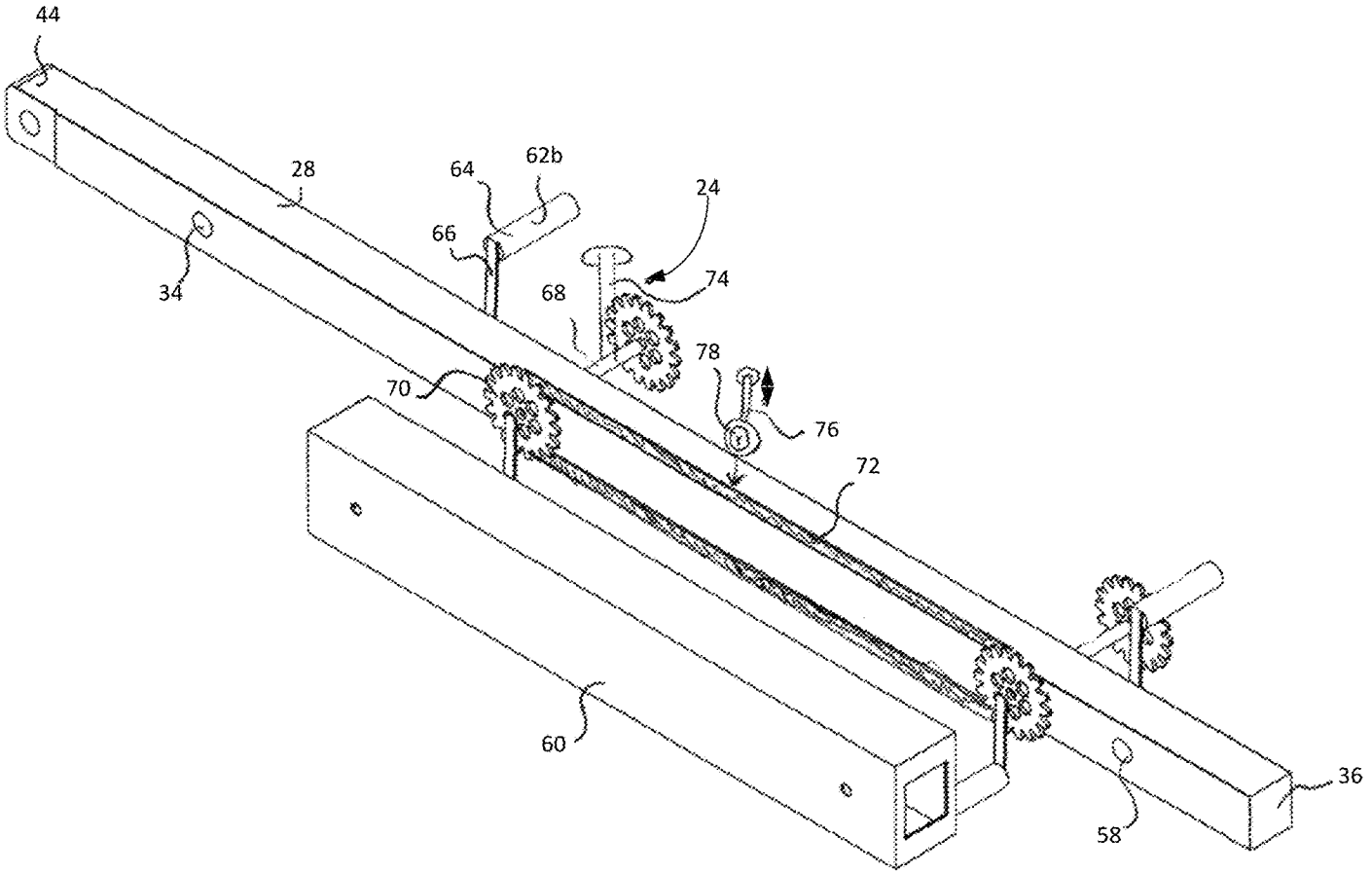
FIG. 3 is a perspective and exploded view of the aspects of the drive system of the present invention.

Referring to FIG. 3, the resistance assembly is shown in more detail. A housing 60 partially encloses the first and second pedal assembly. The first pedal assembly can include a pair of hand cranks 62*a* (FIG. 1) and 62*b*. The hand cranks can include a handle 64 and crank arm 66. The crank arm can be connected to the first axle 68 that can extend through the housing. Gear or pulley 70 can be attached to the axle so that when the first pedal assembly is rotated, the gear forces linkage 72 to cause the second pedal assembly to rotate. A resistance member 74 can be included so that when the resistance member is raised or lowered, resistance is placed on the axle increasing the amount of force required to rotated the axle. A linkage tension assembly 76 can include a tension idler 78 so that when the tension idler is pressed against the linkage, resistance is increased causing more force to be needed to rotate the first pedal assembly. In one embodiment, the first pedal assembly can be used for the hand or feet.

Figure 4:
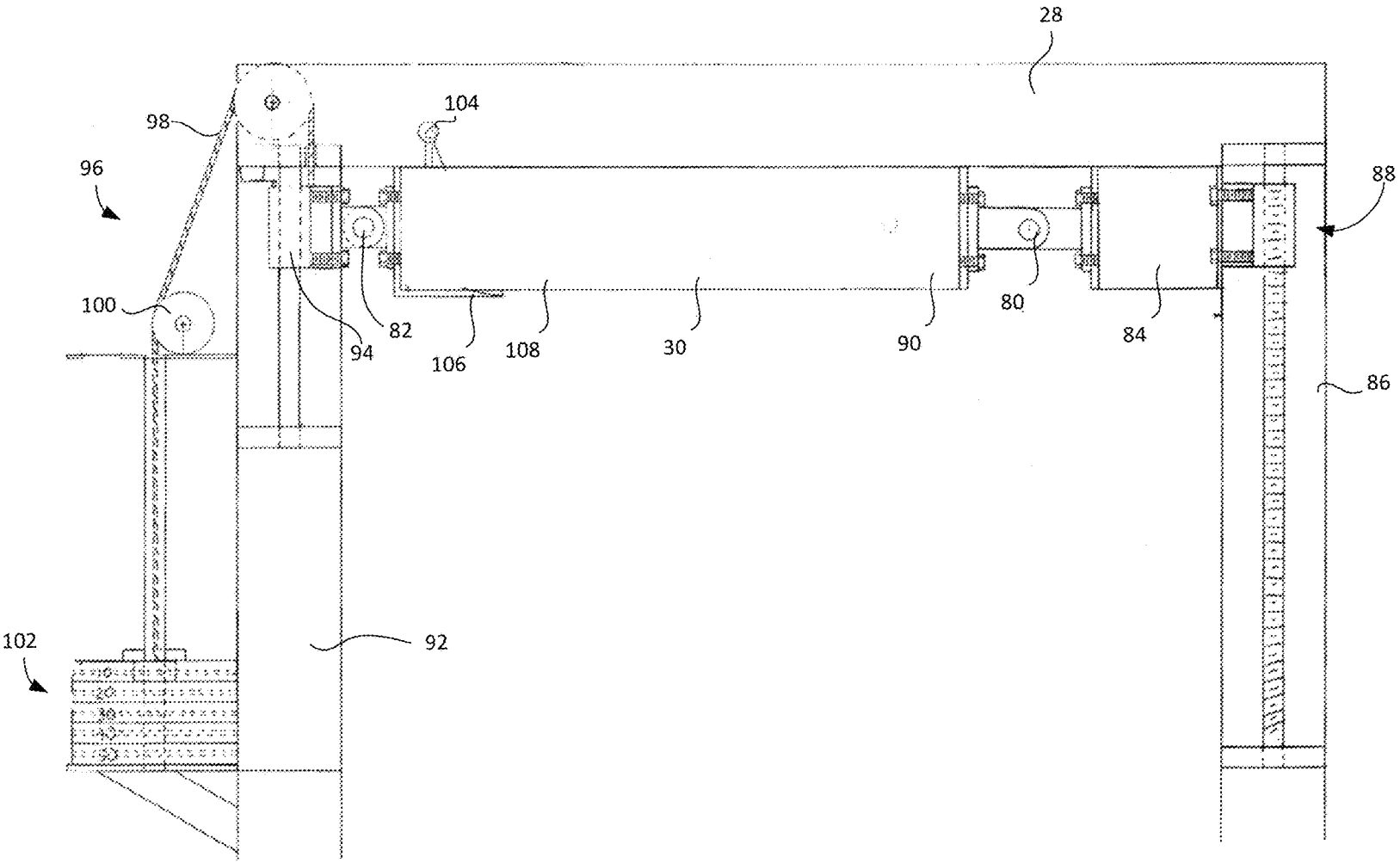
FIG. 4 is a side view of aspects of the present invention.

Referring to FIG. 4, another embodiment of the present invention is shown. In this embodiment, the drive system 30 can be pivotally attached to a first hinge 80 and a second hinge 82. The first hinge can be connected to a first riser 84 that is carried by a first standard 86. The first riser can be positioned vertically along the first standard by a first riser assembly 88 allowing the distal end 90 of the drive system to move vertically. In the horizontal position the individual can perform exercises in an inclined position. A beam 28 can support the drive system and be supported by the first standard and a second standard 92. The second riser assemble 94 can include a counter weight system 96 including a combination of operatively connected cables 98, pulleys 100, and weights 102. The weights can also be used as resistance so that when the individual pulls down on the drive system, the weights create resistance resulting in the exercise for the individual. In one embodiment, the distal end 90 can be released form the first riser assembly to allow the drive system to be placed in a vertical position. A pin 104 can be attached to the drive system and be received in a slot in the beam to allow the drive system to attach to the beam. In one embodiment, the drive system is slidably attached to the beam. In one embodiment, the drive system is carried by a carrier 106 at the proximal end 108 of the drive system.

Figure 5:
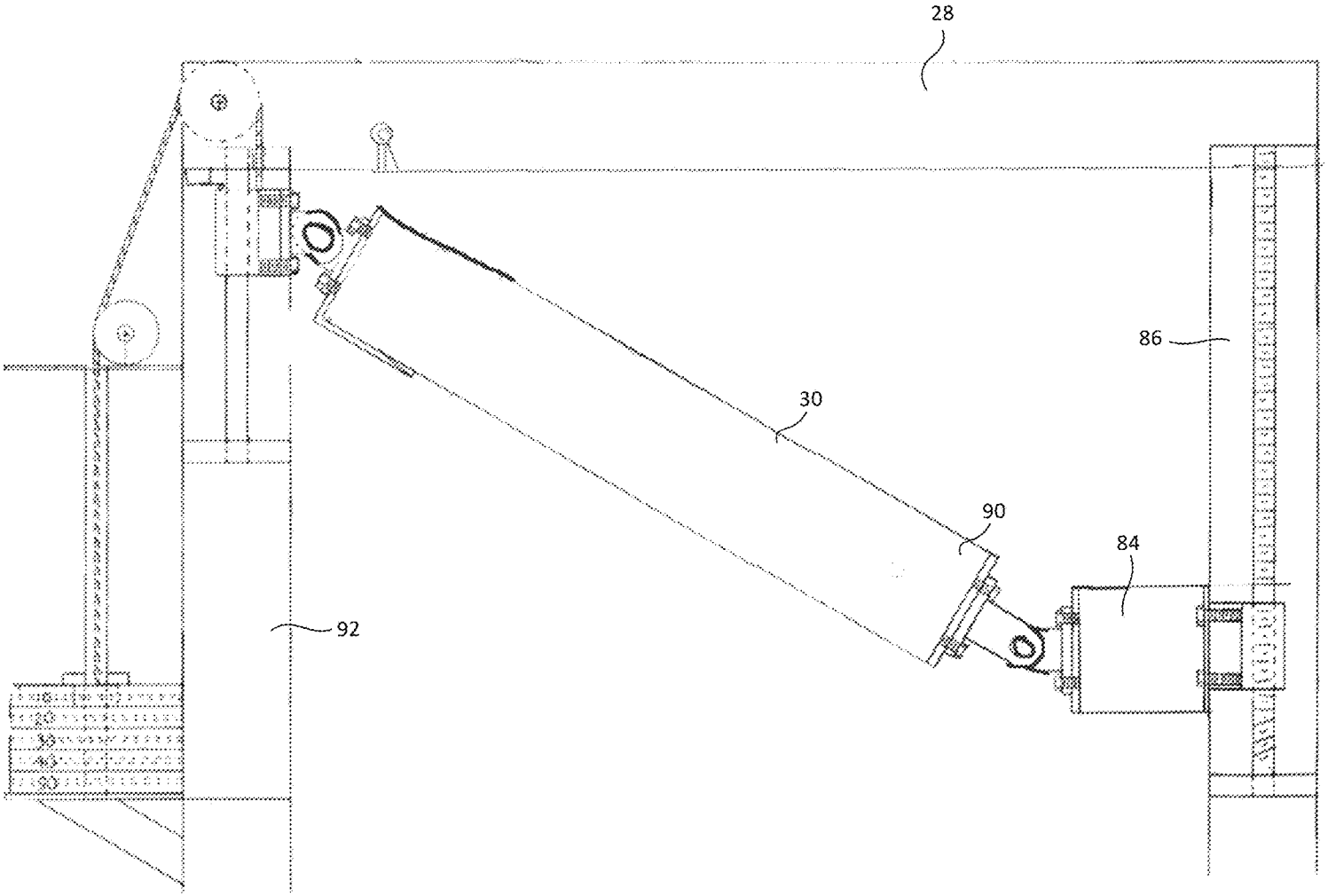
FIG. 5 is a side view of aspects of the present invention.

FIG. 5 shows this embodiment in a vertical position allowing exercise to be performed while in a seated position.

Figure 6:
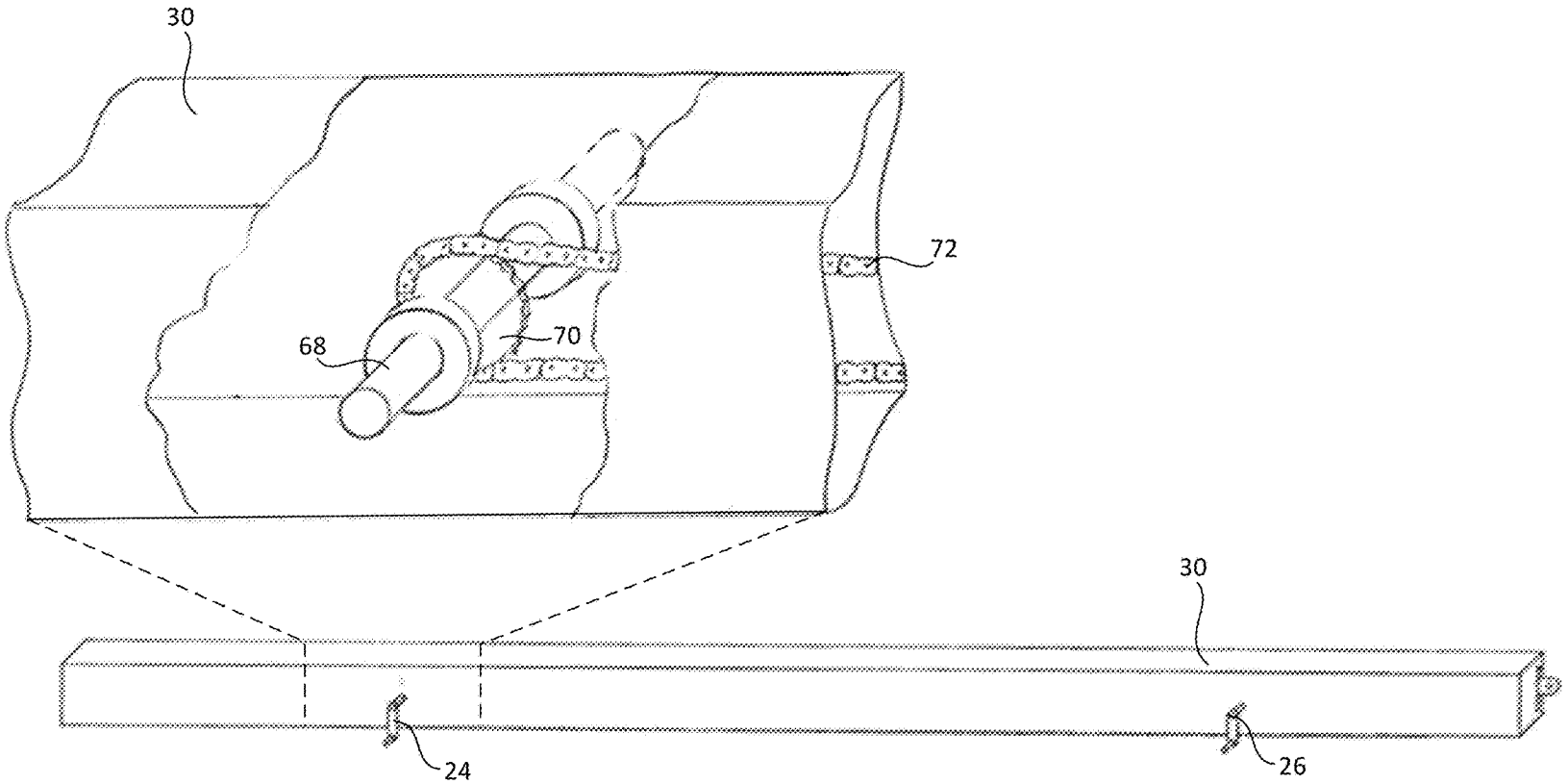
FIG. 6 is a perspective view of aspects of the drive system of the present invention.

A first and second pedal assembly can be included on the drive system in this embodiment as shown in FIG. 6. The axle 68 can be connected to gear 70 so that when the first pedal assembly is rotated, linkage 72 to rotate a second pedal assembly.

Figure 7A:
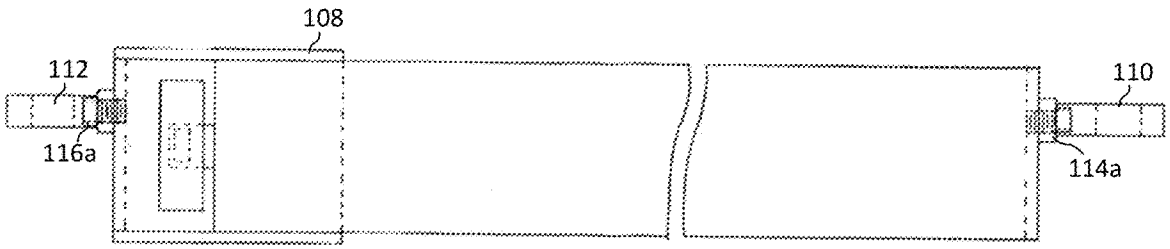
FIGS. 7A and 7B are a top view and side view of aspects of the drive system respectively.
Figure 7B:
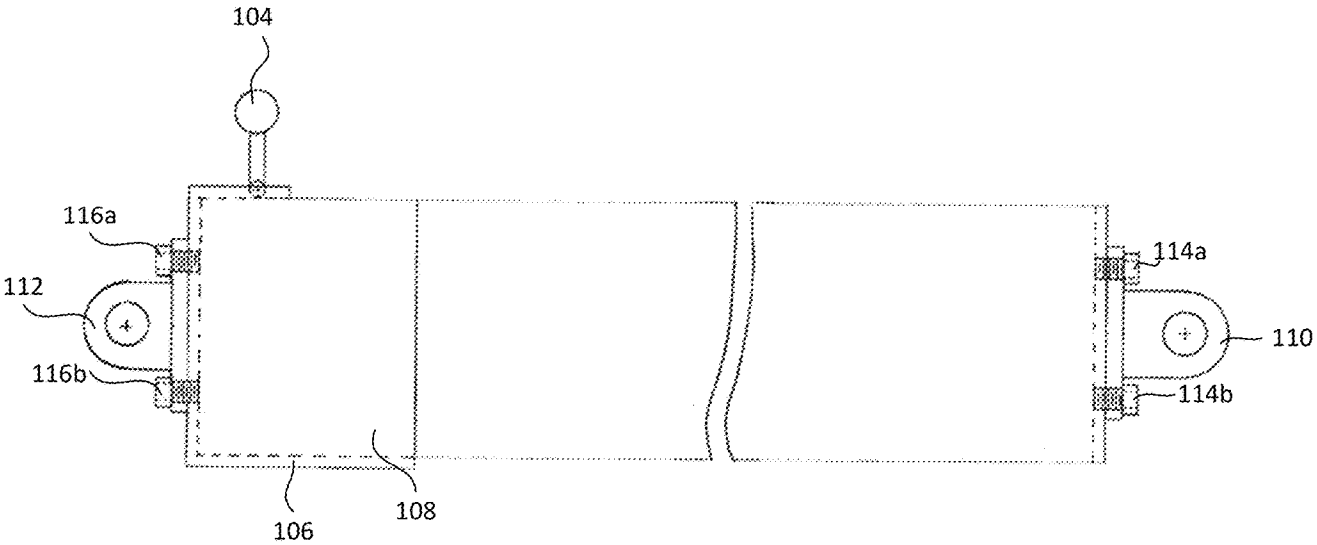

Referring to FIGS. 7A and 7B, one embodiment of a drive system is shown. The proximal end 108 is carried by the carrier and can be released from the carrier. The drive system can include a first pivot member 110 attached to the drive system and a second pivot member 112 attached to the drive system. In one embodiment, the pivot members are attached to the drive system with bolts 114*a*, 114*b*, 116*a*, and 116*b*.

Figure 8:
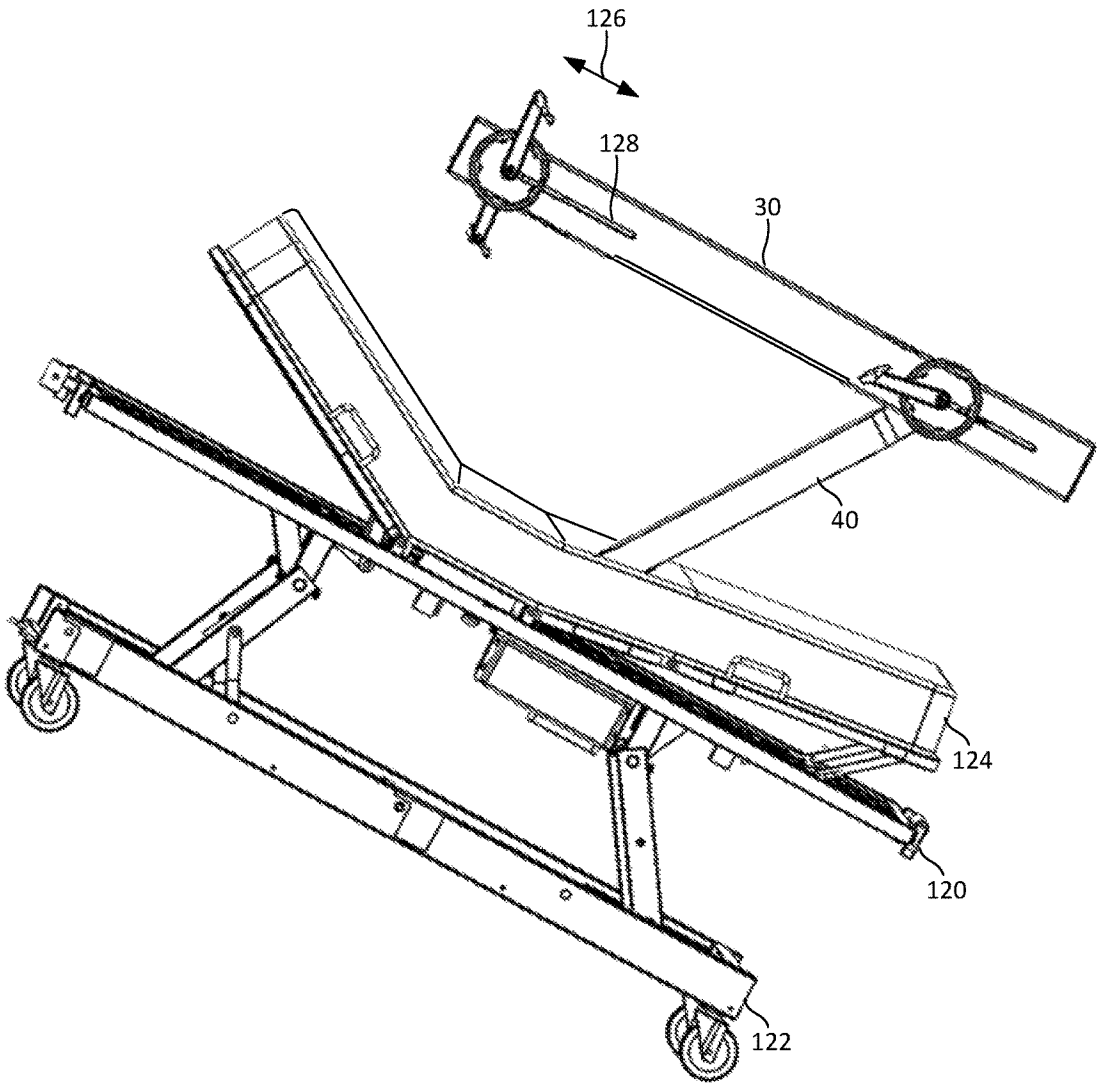
FIG. 8 is a perspective view of aspects of the invention.

Referring to FIG. 8, the horizontal surface can be a bed support 120 and can be attached to a bed frame 122. A mattresses is supported by the bed frame and can have a reclined or inclined position to raise or lower the upper body of the individual supported by the mattress. The resistance assembly can be position generally horizontally above the mattress and bed support allowing the injured individual to use the resistance assembly when in a reclined or partially reclined position. The master pedal assembly can be adjusted along the length of the drive system in direction 126 to allow for the master pedal assembly to be moved toward or away from the head of the bed allowing the master pedal support to be adjusted to the needs of the individual. When the drive system and therefore resistance assembly is in a generally horizontal position, the horizontal support, vertical standard and resistance assembly form generally a "Z" configuration.

Figure 9:
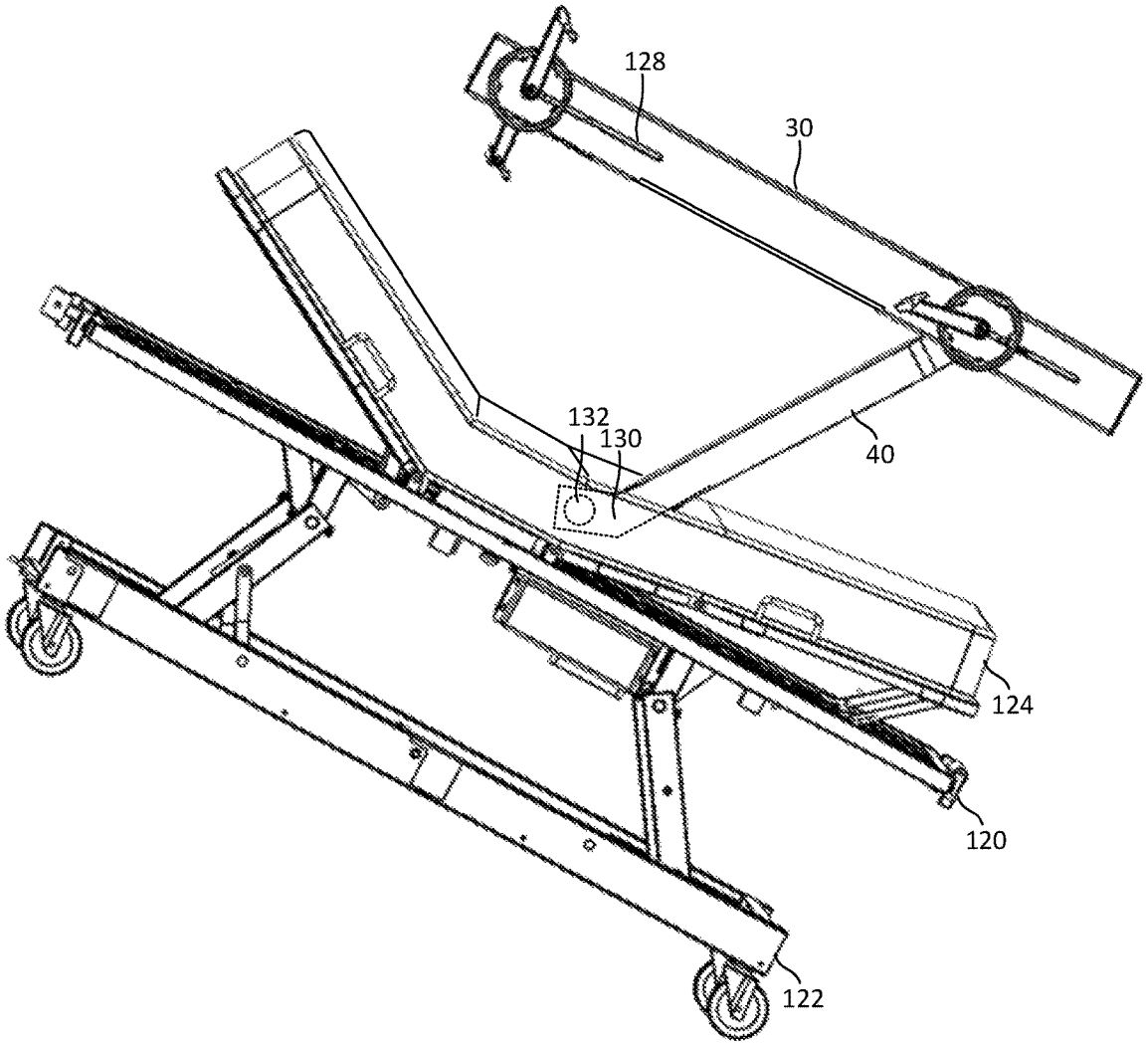
FIG. 9 is a side view of aspects of the invention.
Figure 10:
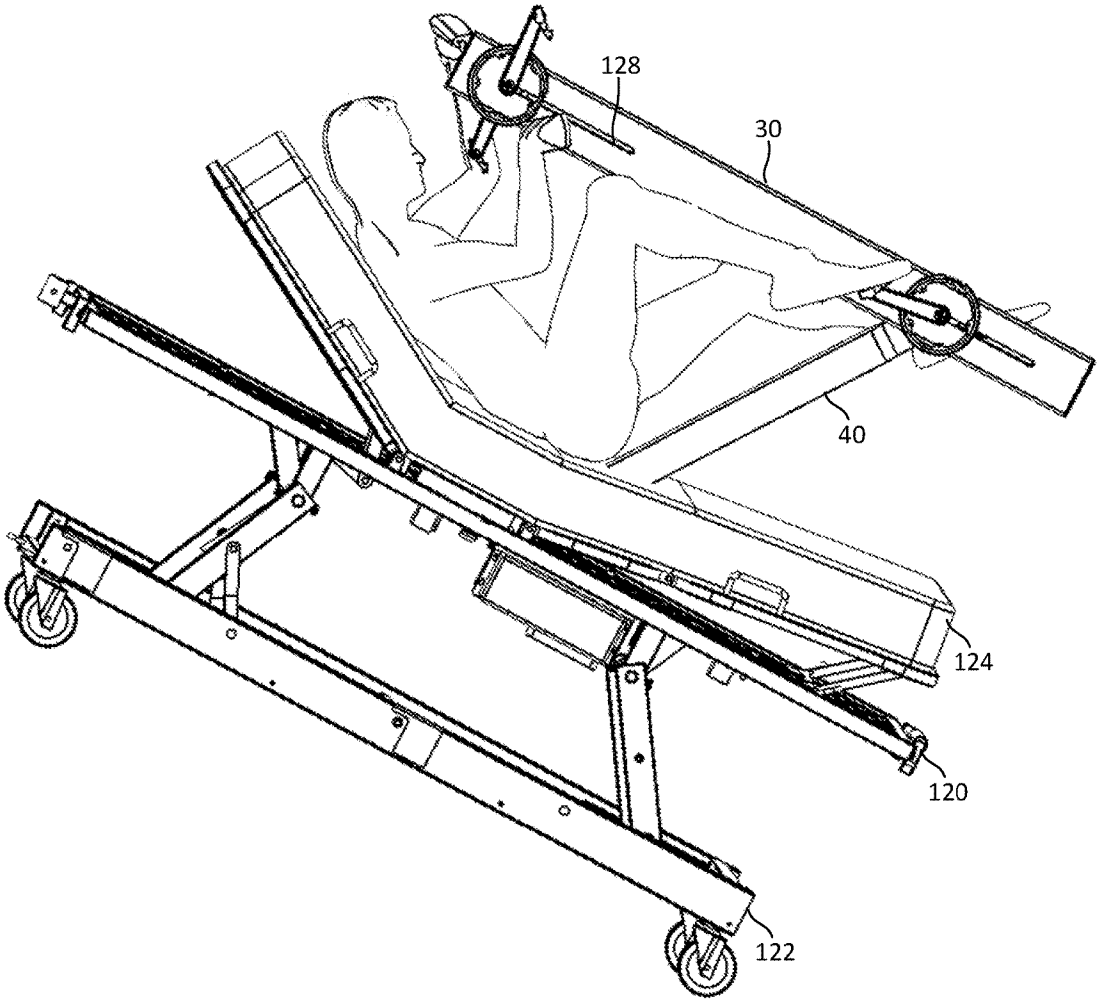
FIG. 10 is a perspective view of aspects of the invention.

Referring to FIGS. 9 and 10, the vertical standard 40 is shown attached to the horizontal support 124 at support pivot 132. A distal end 130 of the vertical standard is attached to the support pivot allowing the vertical standard to move vertically. When the vertical support moves vertically, the resistance assembly can be positioned closer or farther away from the horizontal support. When the vertical standard is moved vertically, the angle of the vertical standard can cause the resistance assembly to move toward or away from the head of the bed while the vertical standard is moving vertically. Therefore, the master pedal assembly and the slave pedal assembly can be adjusted along the drive system. As seen in FIG. 10, the support pivot can be positioned under the individual using the drive system to stabilize the vertical standard from unnecessary movement.

Figure 11A:
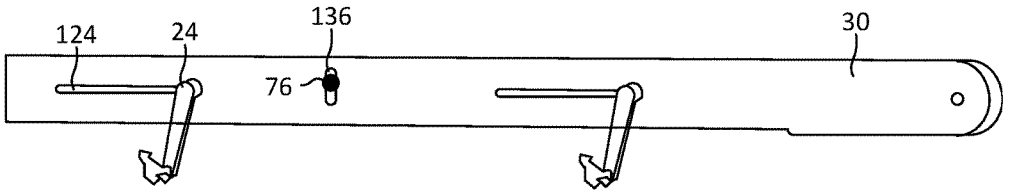
FIGS. 11A through 11C are side views of aspects of the present invention; and, FIG. 12 is a perspective view of aspects of the invention.
Figure 11B:
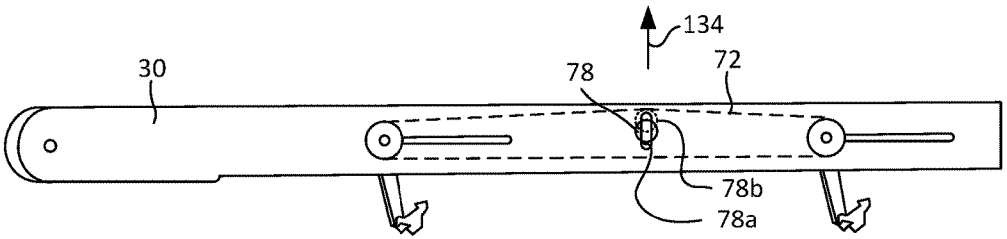

Referring to FIG. 11A, the drive system is shown from an outer perspective. The master pedal assembly can be positioned along the drive system using slot 128. A tension slot 136 can be defined in the drive system. The linkage tension assembly 76 can be received in the tension slot and extend into the interior of the drive system. Referring to FIG. 11B, the linkage tension assembly can be connected to a tension member or tension idler 78 interior to the drive system. The tension idler can move from a first position 78*a* to a second position 78*b* and can be in contact with linkage 72 to apply outward force in a direction shown as 134 when it is moved from the first position to the second position which results in an adjustable radial force applied to linkage 72 to vary the tension between the master pedal assembly and the slave pedal assembly.

Figure 11C:
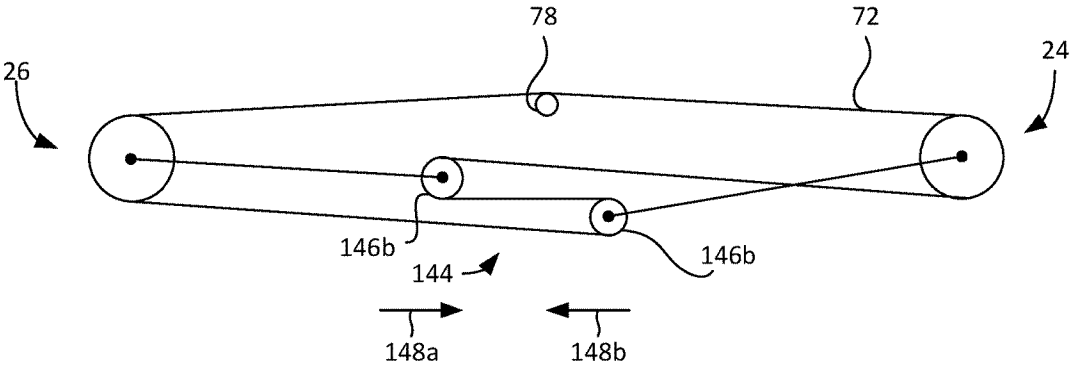

Referring to FIG. 11C, the idler assembly 144 is shown in further detail. The idler assembly can include a forward idler 146*b* and a rearward idler 146 a biased toward each other in a direction 148*b* and 148*a* respectively so that when the master pedal assembly is positioned closer to the slave pedal assembly within the drive system the idler assembly reduces the slack created in the linkage. The slave pedal assembly can be connected to the rearward idler so that when the slave pedal assembly is moved toward the master pedal assembly along the drive system, the slack in the linkage is taken up by the idler assembly. The master pedal assembly can be connected to the forward idler so that when the master slave pedal assembly is moved toward the slave pedal assembly along the drive system, the slack in the linkage is taken up by the idler assembly. By connecting the idlers to the pedal assemblies, when the tension member increases tension in the linkage, the idlers would not be pulled together as the pedal assemblies can be secured within the slots in the drive system.

Figure 12:
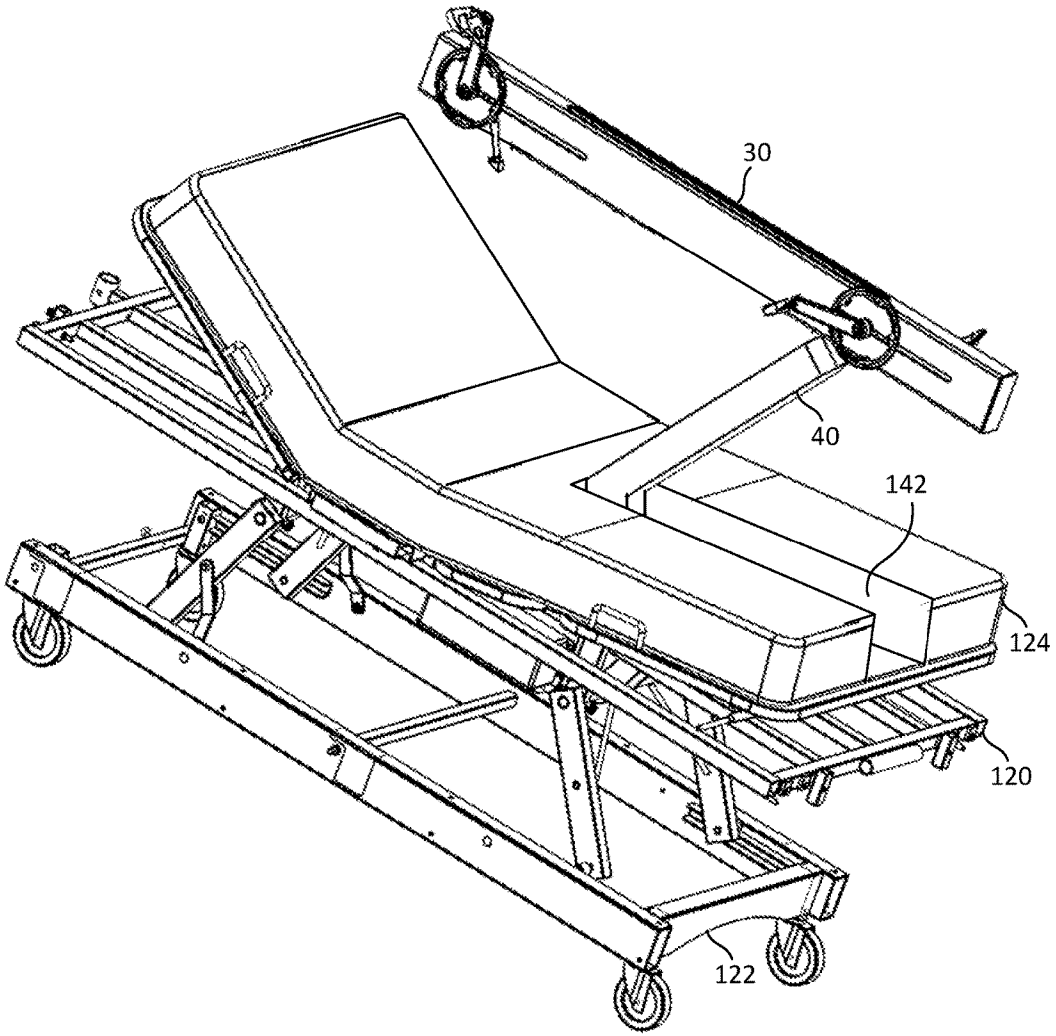

Referring to FIG. 12, the vertical standard can be connected to the horizontal support. A mattress can be supported by the horizontal support and can include a mattress slot for receiving the vertical standard. When the vertical standard is lowered, the vertical standard can be received on the mattress slot and allow the drive system to be positioned closer to the individual supported by the mattress. The drive system can also be positioned generally vertically allowing the master pedal assembly to be positioned above the slave pedal assembly allowing the individual to access the drive system while in a sitting position and supported by the horizontal support.

Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements, or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art using the teachings disclosed herein.

What is claimed is:

1. An exercise assisting apparatus for an individual with limited mobility comprising:

a frame attached to a support and having a vertical standard, an upper extension and an upper overhang;

a resistance assembly rotateably attached to the upper overhang at a pivot and configured to rotate between a generally horizontal position configured to provide exercise assistance to the individual in a horizontal position and a generally vertical position configured to provide exercise assistance to the individual in a seated position;

a pivot pin receiving in a beam included in the resistance assembly and the upper extension to secure the resistance assembly in the generally horizontal position;

a stabilizing pin received into the vertical standard and a distal end of the resistance assembly when the resistance assembly is in the generally vertical position configured to secure the resistance assembly in the generally vertical position;

a drive system slidably attached to the beam and including a master pedal assembly configured to be actuated by hands and arms of the individual, the master pedal assembly including a master axle and a pair of offset master pedals attached to a master pulley;

a slave pedal assembly included in the drive system configured to support feet and legs of the individual, the slave pedal assembly including a slave axle and a pair of slave pedals attached to a slave pulley;

a linkage connecting the master pedal assembly with the slave pedal assembly configured to actuate the slave pedal assembly when the master pedal assembly is actuated;

the master pedal assembly, slave pedal assembly and linkage cooperatively slidable along the drive system to vary a distance between the master pedal assembly and the slave pedal assembly;

an idler assembly included in the drive system having a forward idler and a rearward idler biased toward each other so that when the master pedal assembly is positioned closer to the slave pedal assembly within the drive system the idler assembly reduces a slack created in the linkage; and, a tension idler in contact with the linkage configured to apply force to the linkage to vary a tension between the master pedal assembly and the slave pedal assembly.

2. The apparatus of claim 1 wherein:

the slave pedal assembly is connected to the rearward idler so that when the slave pedal assembly is moved toward the master pedal assembly along the drive system, the slack in the linkage is taken up by the idler assembly; and, the master pedal assembly is connected to the forward idler so that when the master pedal assembly is moved toward the slave pedal assembly along the drive system, the slack in the linkage is taken up by the idler assembly.

3. The apparatus of claim 1 including a pair of forks attached to the support projecting inward defining a space for receiving a chair so that when the resistance assembly is in the vertical positions, the individual accesses the drive system while sitting.

4. The apparatus of claim 3 wherein the pair of forks is received under a horizontal surface to position the resistance assembly above the horizontal surface when the resistance assembly is in the generally horizontal position so that the individual supported by the horizontal surface assesses the drive system when supported by the horizontal surface.

5. An exercise assisting apparatus for an individual with limited mobility comprising:

a frame attached to a support and having a vertical standard;

a beam rotatably attached to the support at a pivot and configured to rotate between a generally horizontal position and a generally vertical position;

a drive system slidably attached to the beam and including a master pedal assembly configured to be actuated by hands and arms of the individual;

a slave pedal assembly included in the drive system configured to support feet and legs of the individual;

a linkage connecting the master pedal assembly with the slave pedal assembly so that when the master pedal assembly is actuated, the slave pedal assembly is actuated; and, a tension idler in contact with the linkage configured to apply force to the linkage thereby varying a tension between the master pedal assembly and the slave pedal assembly to vary a resistance of the master pedal assembly when used by the individual.

6. The assembly of claim 5 including:

an idler assembly included in the drive system having a forward idler and a rearward idler; and, the slave pedal assembly is connected to the rearward idler so that when the slave pedal assembly is moved toward the master pedal assembly along the drive system, a slack in the linkage is taken up by the idler assembly.

7. The assembly of claim 5 including:

an idler assembly included in the drive system having a forward idler and a rearward idler; and, the master pedal assembly is connected to the forward idler so that when the master slave pedal assembly is moved toward the slave pedal assembly along the drive system, a slack in the linkage is taken up by the idler assembly.

8. The apparatus of claim 5 including a pair of forks attached to the support projecting inward defining a space for receiving a chair so that when the beam assembly is rotated into the generally vertical position, the individual assesses the drive system while sitting and wherein the pair of forks is received under a horizontal surface to position the beam above the horizontal surface when the beam is rotated into the generally horizontal position so that the individual supported by the horizontal surface accesses the drive system while laying down.

9. An apparatus for an individual with limited mobility comprising:

a vertical standard;

a beam rotateably attached to the vertical standard and configured to rotate between a generally horizontal position and a generally vertical position;

a drive system attached to the beam and including a master pedal assembly and a slave pedal assembly;

a linkage connecting the master pedal assembly with the slave pedal assembly so that when the master pedal assembly is actuated, the slave pedal assembly is actuated; and, a tension idler in contact with a master axle included in the master pedal assembly to apply force on the linkage thereby varying a tension on the master pedal assembly to vary a resistance of the drive system when used by the individual.

10. The apparatus of claim 9 including:

an idler assembly included in the drive system;

a forward idler included in the drive system; and, a rearward idler included in the drive system wherein the forward idler and the rearward idler are biased toward each other so that when the master pedal assembly is positioned closer to the slave pedal assembly, the idler assembly takes up a slack created in the linkage.

* * * * *